US010408480B1

(12) United States Patent
Hardy

(10) Patent No.: US 10,408,480 B1
(45) Date of Patent: Sep. 10, 2019

(54) LOW HUMIDITY GENERATOR

(71) Applicant: Robert O. Hardy, Gilbert, AZ (US)

(72) Inventor: Robert O. Hardy, Gilbert, AZ (US)

( * ) Notice: Subject to any disclaimer, the term of this patent is extended or adjusted under 35 U.S.C. 154(b) by 22 days.

(21) Appl. No.: 15/928,221

(22) Filed: Mar. 22, 2018

(51) Int. Cl.
*F24F 11/00* (2018.01)

(52) U.S. Cl.
CPC ..... *F24F 11/0008* (2013.01)

(58) Field of Classification Search
CPC ..... F24F 11/0008; F24F 1/0087; F24F 3/14; F24F 3/1405; F24F 3/153; F24F 6/00; F24F 6/02; F24F 2203/00
USPC ..... 165/222, 230
See application file for complete search history.

(56) References Cited

U.S. PATENT DOCUMENTS 2,057,236 A * 10/1936 Hodge ..... F24F 6/06 236/44 A
2,580,404 A * 1/1952 Bush ..... F24F 3/14 34/406
3,532,270 A 10/1970 Schoen, Jr.
3,665,748 A 5/1972 Mator
3,748,828 A * 7/1973 Lefebvre ..... B01D 1/14 95/64
4,269,057 A 5/1981 Ong
5,971,609 A 10/1999 Kijima
8,904,850 B1 12/2014 Allendorf
2014/0000235 A1* 1/2014 Kamen ..... F01K 25/00 60/39.6

OTHER PUBLICATIONS

Edgetech Inst DewGen-Brochure-v5, attached non-patent literature.
Greenspan Low Frost-Point Humidigy Generator, attached non-patent literature.
Meyer Design and Performance of the, attached non-patent literature.
Michell Inst DCS_97162_US_Datasheet-V2, attached non-patent literature.
Space et al Performance of a Precision, attached non-patent literature.
Space et al The New NIST Low, attached non-patent literature.
Sturm et al Permeation of atmospheric, attached non-patent literature.
Thunder Scientific 2500 System, attached non-patent literature.
Thunder Scientific 3900 System 2, attached non-patent literature.
Thunder Scientific 3900 System, attached non-patent literature.

* cited by examiner

*Primary Examiner* — Tho V Duong
(74) *Attorney, Agent, or Firm* — Mark V. Loen

(57) ABSTRACT

The embodied invention is a low humidity generator which encapsulates essential piping, pressure regulator, flow regulator, and saturator in a sealed vacuum chamber. Additionally, Stirling piston type coolers are used to cool the saturator. This eliminates atmospheric water vapor permeation and the need for thermal insulation surrounding the piping and control units. Also, the humidity generator has improved cool down characteristics, improved thermal control, and better maintenance access.

19 Claims, 10 Drawing Sheets

LOW HUMIDITY GENERATOR

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION

(1) Field of the Invention

This invention is directed to improvements in low humidity gas generators (also terms low dew point, low frost point, or low moisture generators) that provide a very dry exit stream gas with controlled humidity in the range of −90° C. frost point to +20° C. The exit stream gas is used to verify humidity measuring instruments in a variety of fields, including medical, industrial, environmental, and aerospace.

(2) Description of Related Art

There are several low humidity generators currently on the market that provide a low humidity reference within a carrier gas such as nitrogen or compressed air. The designs follow a NIST two pressure, two temperature design where a saturator is used to establish the amount of water vapor in a carrier gas stream. The mixing ratio of the partial pressure of water vapor to the partial pressure of the carrier gas (such as dry air or nitrogen) is established by conditions of temperature and pressure within a saturator. Prior to use within a downstream Device Under Test (DUT), the gas is expanded to a lower final pressure through an exit valve or orifice, warmed to a final temperature, or both. The amount of water vapor in the generated gas, as established by the saturation process, then follows standard formulations when converted to the humidity parameter expressed for use within the DUT. The saturator operates over a wide temperature range which includes temperatures near water freezing temperature, down to temperatures as low as −90° C. Based on saturator temperature and pressure, the resulting exit gas stream is controlled to water vapor concentrations as high as approximately 2% by volume, down to concentrations in the parts per billion range.

The humidity generators are susceptible to a variety of issues in their attempt at providing a very dry reference gas stream at a highly accurate humidity content. Instrumentation accuracy limitations, thermal issues, and control issues are design challenges that arise when pushing the limits of accuracy to create confidence.

Several problems in the current technology have a significantly negative impact on the amount of water vapor in the exit gas stream. Permeation of water vapor into the gas stream from outside sources is one such significant problem caused by pneumatic connections between tubing, instruments, and control valves, and the use of elastomeric sealing materials such as O-rings. O-rings are known to be permeable to water vapor and thus will permeate water vapor from surrounding atmospheric air to the gas stream. Even though the humidity generator gas piping is at a higher internal pressure than the outside surrounding atmospheric pressure, water vapor may still permeate through the O-ring due to relatively high partial water vapor pressure in the atmosphere surrounding the O-ring versus the significantly lower partial pressure of the water vapor in the exit gas stream. See "Permeation of atmospheric gases through polymer O-rings used in flasks for air sampling" by P. Sturm et al. (Journal of Geophysical Research 25 Feb. 2004, DOI: 10.1029/2003JD004073) for a more detailed explanation regarding O-ring permeation effects. Metal to metal contact fittings are also known to be a permeation problem, but to a much lesser extent.

Due to the need for the saturator to be controlled to very low temperatures, insulation must be added to current designs. The primary purpose of insulation is to serve as a thermal isolator. Secondarily, insulation attempts to prevent undesired condensation of water vapor from the surrounding environment onto cold components. Undesired condensation on component surfaces or circuits may result in corrosion or malfunction. The insulation is wrapped, blown, or packed in around any part of the unit that needs to be thermally cooled and controlled, or it may be poured or sprayed in as chemically expanding foam and allowed to expand in and around those components requiring temperature isolation. However, when maintenance is required, it is difficult to obtain access to any of the piping, control valves, or instrumentation without damaging the insulation. After performing maintenance, it is common for the insulation to be damaged which lowers confidence in the integrity of the thermal control, and in turn, lowers confidence that the water amount in the reference gas stream is accurate.

Current designs utilize a multi-stage cascade refrigeration system to cool the saturator to the desired temperature. The design of the cooling system results in a very slow cool down on the initial startup and at any time the saturator temperature is commanded to a low temperature. Cool down of the saturator from ambient to −90° C., for example, typically requires a full day or more. This is unsatisfactory for many installations, as the unit startup requires extended monitoring by instrumentation personnel who must be scheduled for two days when the humidity generator is at a remote site. Also, any action that causes the need for shutdown of the humidity generator, such as, will require an additional day for the unit to cool down. This unsatisfactorily lowers reliability and creates dissatisfaction with the humidity generator.

What is needed in the art are improvements in thermal control, the elimination of permeation, elimination of undesired condensation on and around cool components, and improvements in operational reliability.

BRIEF SUMMARY OF THE INVENTION

The embodied invention is a low humidity gas generator which encapsulates essential piping, pressure regulator, flow regulator, and saturator contained within a sealed vacuum chamber. Use of the vacuum chamber eliminates atmospheric water vapor permeation and the need for thermal insulation surrounding the piping and control units. Additionally, Stirling coolers (more accurately Free-Piston Stirling Coolers, FPSC) are used to cool the saturator. With these improvements, the humidity generator has better accuracy at low humidity due to reduced permeation effects, improved thermal insulation and control, faster cool down characteristics, and better maintenance access.

BRIEF DESCRIPTION OF THE SEVERAL VIEWS OF THE DRAWING(S)

DETAILED DESCRIPTION OF THE INVENTION

Figure 1:
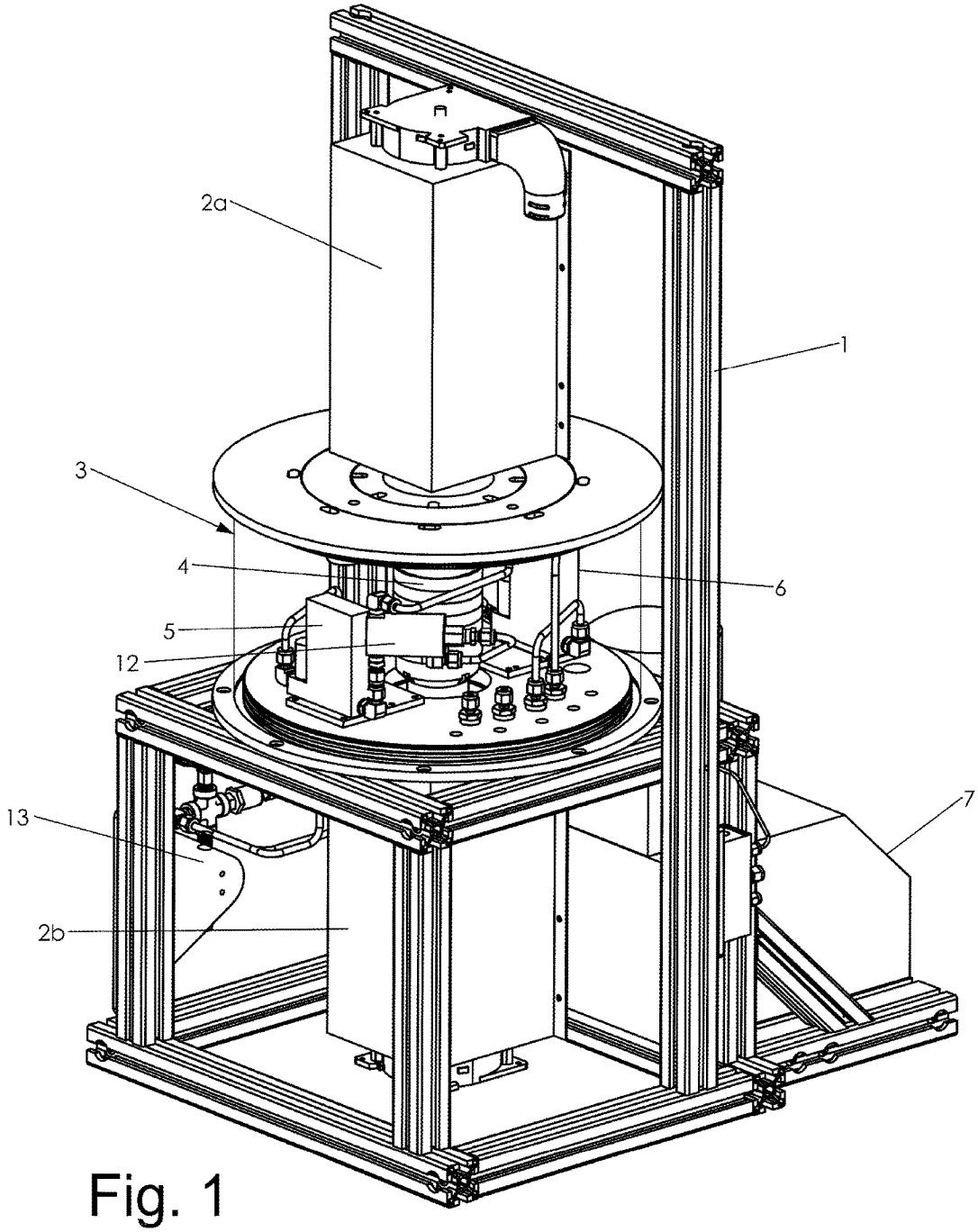
FIG. 1 shows a perspective view of the assembled humidity generator.

The text 'humidity generator' means a complete unit that receives an input gas (or carrier gas), adding a specific amount of water vapor to the input gas, and provides an exit gas flow at a designated moisture content. The text 'humidity saturator' or 'saturator' refers to a thermally controlled stacked plate unit that allows the input gas to admix with water vapor. (Note that the terms 'humidity', 'moisture', 'dew point', 'frost point', 'water vapor', and 'water vapor partial pressure' are used synonymously within the context of this document. While they may exhibit differing numeric values, they are all directly proportional and mathematically convertible to one another. They are alternate terms for expressing the concept of water vapor admixed with a carrier gas.)

The embodied humidity generator follows an overall design based on NIST two pressure and two temperature principles. Utilizing these principles, a stream of gas at an elevated pressure is saturated with respect to the liquid or solid phase of water at a given saturation temperature. Here, saturation temperature is the major determining factor for the quantity of water vapor admixed with the carrier gas. Pressure within the saturator is the major determining factor for the carrier gas quantity of the mixture. The humidified gas stream is then expanded to a lower pressure and warmed to an alternate temperature. Measurements of the pressure and temperature within the saturator, and the pressure and temperature following expansion (generally at the DUT), are all that is required to determine the resulting humidity content of the gas stream.

The electronic controls provide for automatic humidity generation based on desired humidity setpoints. The operator adjusts the desired exit flow rate setpoint and the desired dew point in the exit gas. The embedded computer control provides the computations needed to create the saturator temperature and saturator pressure PID control setpoints to achieve the desired gas dewpoint and flow rate. Through the use of appropriate mathematical algorithms within custom software programming, automated setpoint determination is employed to achieve and maintain any humidity value desired within the range of capability of the humidity generator. Although automatically determined by the computer, the operator may over-ride specific setpoints of temperature and pressure, allowing for customized testing functionality. The operator also has full control over the exit flow rate setpoint. While not controlled, both the temperature and pressure of the gas stream at the DUT are monitored, and appropriate adjustments are made to ensure the setpoints of saturator temperature and pressure are adjusted accordingly to maintain steady humidity control at the DUT.

The embodied humidity generator has a very small footprint due to the compact FPSC Stirling cooler units utilized for saturator cooling. Typical outlet temperatures needed from the Stirling coolers are +10° C. to as low as −90° C.

Uncertainty of the pressure measurements plays an important role in the accuracy of generated humidity. The humidity in the outlet stream is based on the absolute outlet pressure and also on the ratio of saturator to outlet (DUT) pressure.

The saturator input pressure is maintained to the desired value by the pressure controller. As there may be a slight pressure drop as the gas passes through the saturator, the saturator pressure used within humidity computations is measured by a pressure sensor nearest the saturator exhaust. Differences between the controlled saturator inlet pressure and the resulting saturator outlet pressure may be used to adjust the saturator inlet pressure setpoint to compensated for the pressure drop. This ensures the saturator pressure nearest the saturator outlet reaches desired saturator pressure setpoint.

Uncertainty of the saturator temperature measurement is very important to the humidity in the exit gas stream. All generated humidity parameters such as dew point and frost point temperature are dependent on saturator temperature, while other values such as % Relative Humidity are also dependent on temperature of the gas at the DUT. In the case where both the saturator and DUT temperatures are required, uncertainty of both temperatures must be considered.

Saturator temperature is maintained by control of the Stirling coolers thermally connected to (i.e. in contact directly or indirectly) to the upper and lower plates of the saturator, and by heaters thermally connected to the Stirling coolers or the upper and lower surfaces of the saturator, or both. In general, heating and cooling of the saturator is done by conduction.

The humidity generator can generate any humidity level within the capabilities of the pressure and temperature ranges of the system.

The exit gas is useful for calibration purposes in a wide variety of industries for:

1. Chilled Mirror Hygrometers.
2. Humidity Sensors and Electrolytic Hygrometers.
3. Environmental testing for various humidity sensors.
4. R&D humidity sensors.

The equipment is used in industries includes aerospace, farming, medical, research and development, pharmacy, plastics industry, and others.

The embodied invention is generally useful to control a low amount of humidity in dry nitrogen or compressed air. However, other gases could also be used.

FIGS. 1-6 show different views of the humidity generator assembly. The items shown in FIGS. 1-6 are:

| | |
|---|---|
| 1 | Humidity Generator Support Frame |
| 2a | Top Free Piston Stirling Cooler |
| 2b | Bottom Free Piston Stirling Cooler |
| 3 | Vacuum Chamber |
| 4 | Saturator (Plate Stack Assembly) |
| 5 | Saturator Pressure Controller Valve |
| 6 | Saturator Exit Gas Flow Controller Valve |
| 7 | Vacuum pump |
| 8 | Vacuum chamber wall |
| 9 | Top Vacuum Flange Part A |
| 10 | Top Vacuum Flange Part B |
| 11 | Bottom Vacuum Flange |
| 12 | Flow-generator & Purge - 3 Way Valve |
| 13 | Nitrogen Inlet Pressure Regulator |
| 14 | Purge outlet valve |
| 15 | Entry On-off Valve |
| 16a,b | Optional Heaters |

FIG. 1 is an isometric view of the humidity generator, showing a vacuum chamber 3 that encloses the saturator 4, the saturator pressure controller valve 5, the flow-purge three-way valve 12, and the exit gas flow control valve 6. These components are surrounded by a vacuum in the vacuum chamber and have 0 rings, gaskets, or connections that are subject to permeation. Also, the enclosed components transfer less heat when in the vacuum chamber and provide better temperature control. Only modest vacuum level i.e. 1E-4 hPa or lower is required.

A gas inlet pressure regulator 13 reduces the high cylinder supply pressure (typically dry air or nitrogen at 200 psi) to a lower pressure for improved pressure control in the saturator. Stirling coolers 2*a*,2*b* provide low temperature cooling to the saturator 4.

Figure 2:
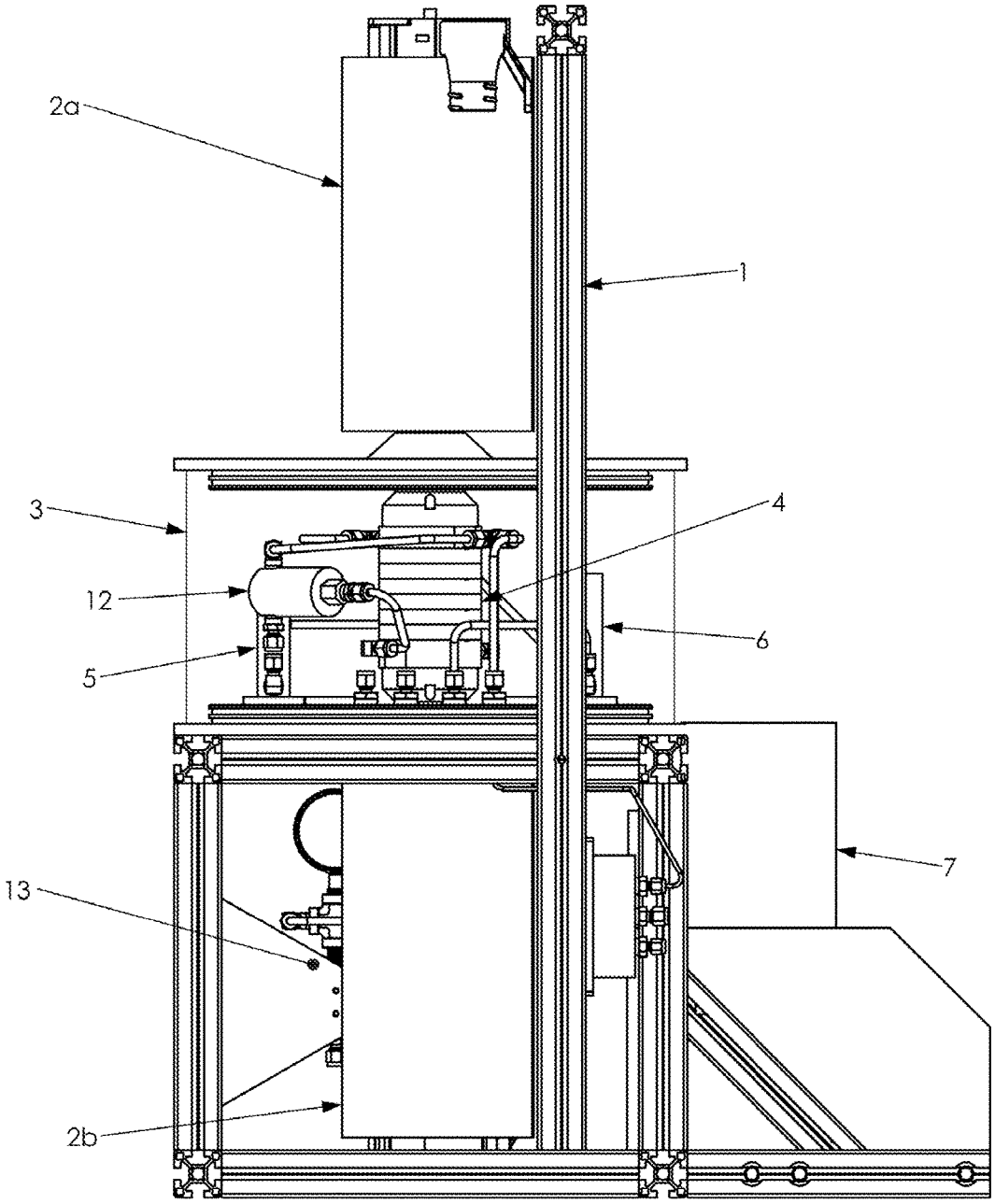
FIG. 2 shows a right side profile of FIG. 1.
Figure 3:
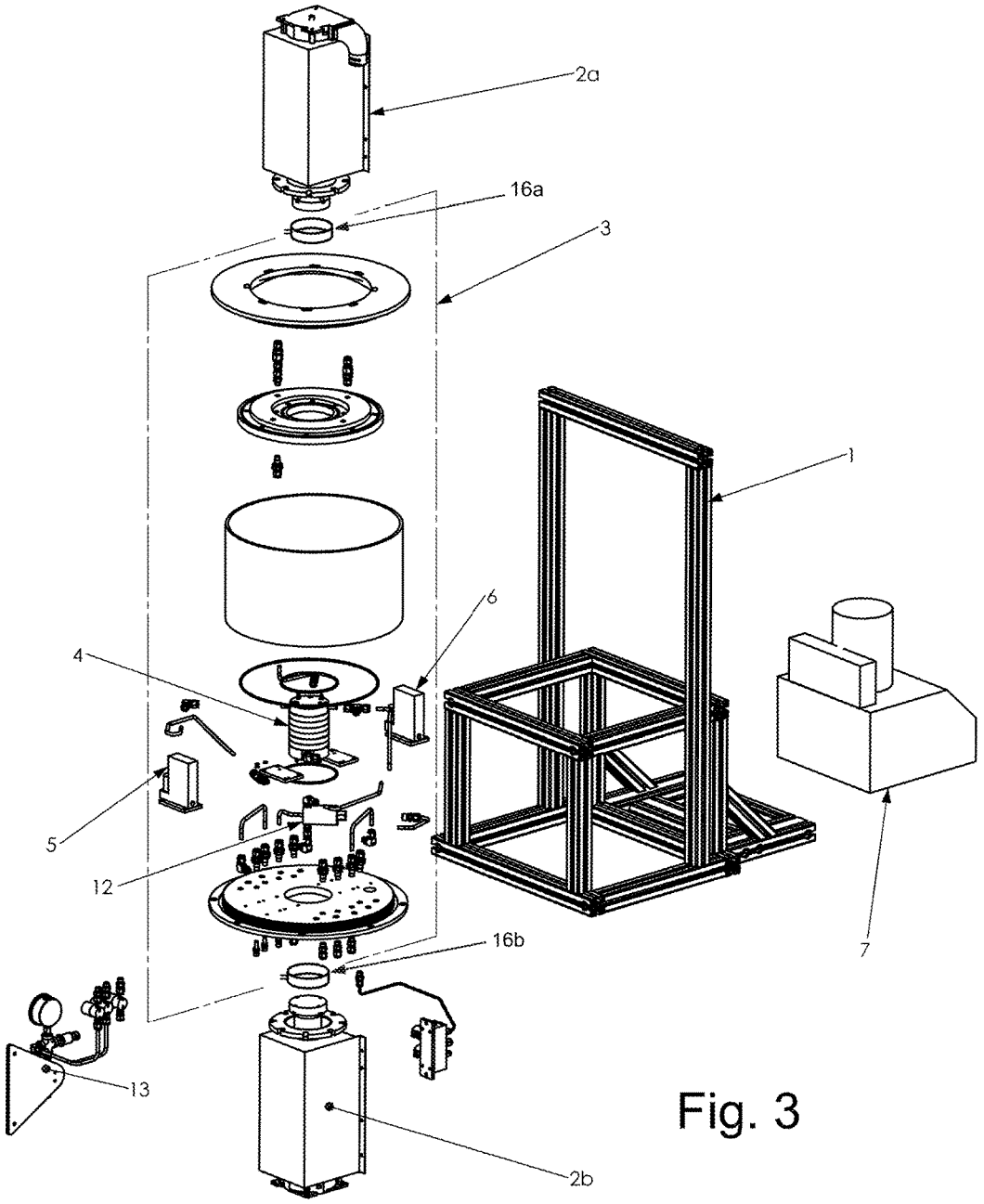
FIG. 3 shows an exploded view of FIG. 1 to better see the humidity generator assembly.
Figure 4:
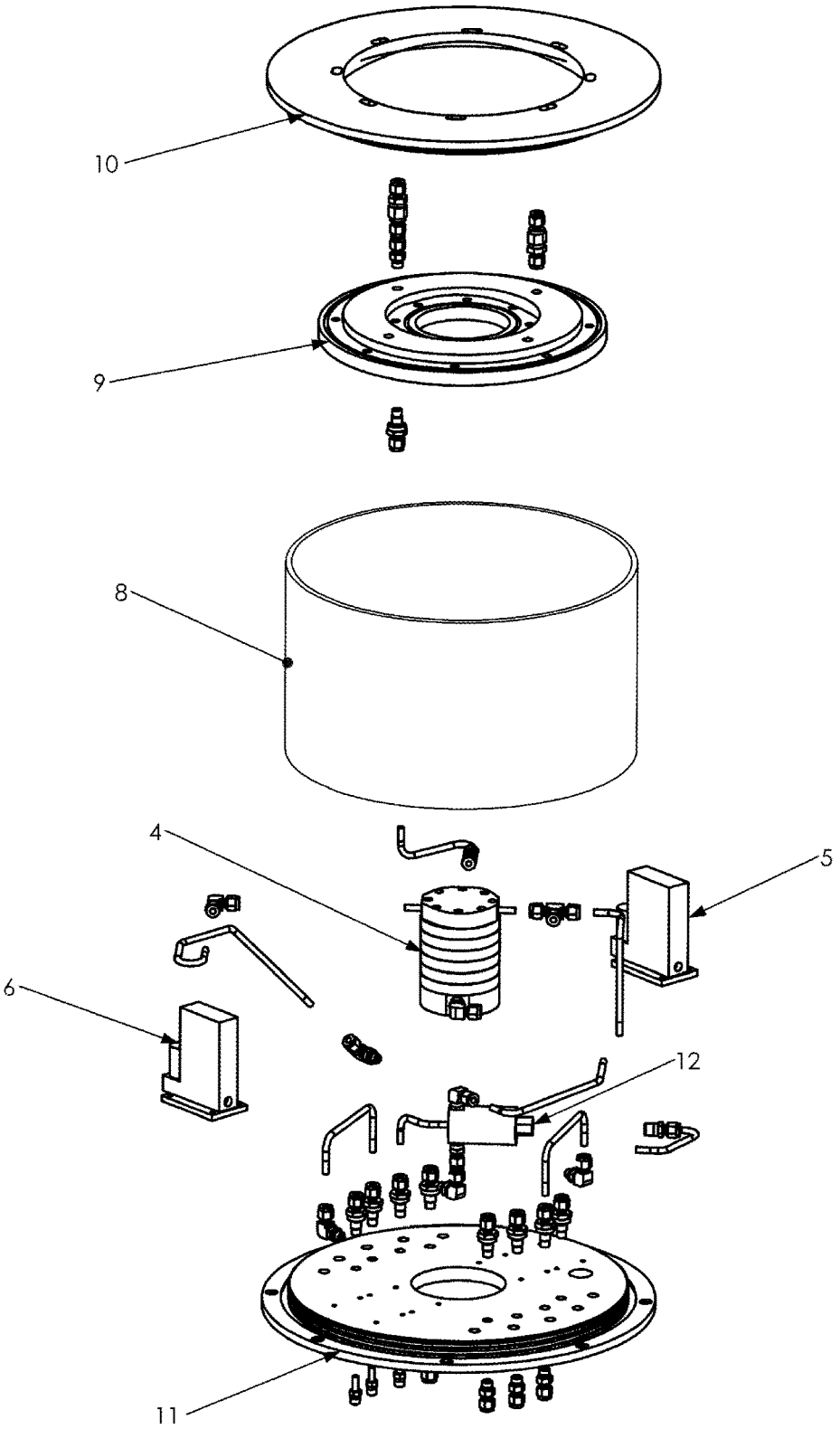
FIG. 4 is a detailed exploded view of FIG. 3 to better see the vacuum chamber assembly.

FIG. 2 shows a right side profile of FIG. 1, while FIG. 3 shows an exploded view of FIG. 1 to better see the humidity generator components. In another embodiment, heaters 16*a,b* provide heating to the saturator, but are not required to control the temperature of the saturator. The heaters preferably encircle the conducting surface of the upper and lower coolers, but may also encircle the upper and lower surfaces of the saturator, or both. FIG. 4 is an exploded view of the vacuum chamber, showing the vacuum flanges 9, 10, 11 as well as various piping and control components.

Figure 5:
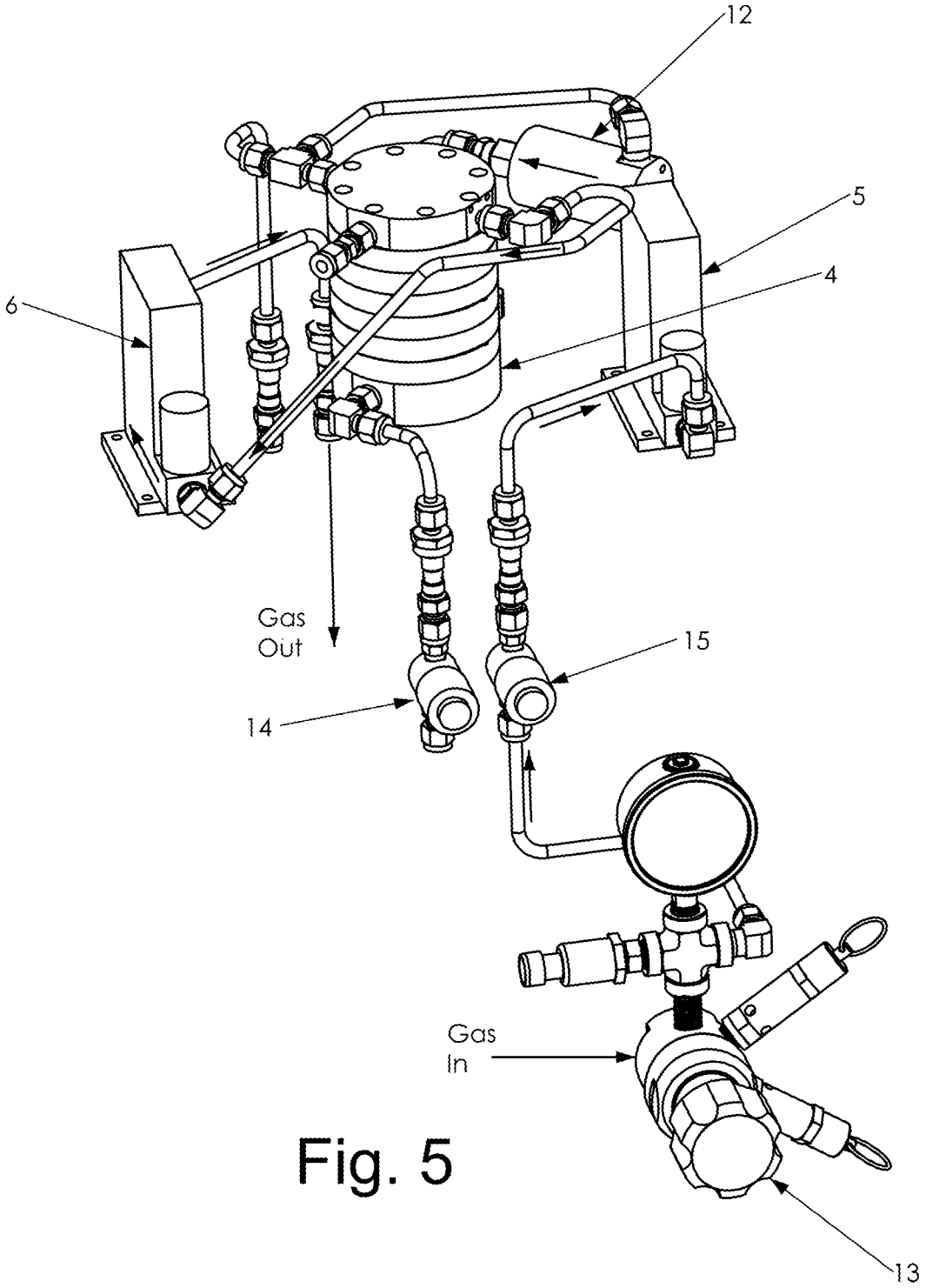
FIG. 5 shows a perspective view of the gas pressure—control sub assembly, with arrows indicating the direction of gas flow during a normal (generator) operation.

FIG. 5 shows the gas flow through the piping and humidity generator components during the normal generation cycle. A gas (i.e. nitrogen) cylinder is connected (gas in) to a pressure regulator valve 13 where the gas pressure is regulated down to approximately 150 psi. The gas then follows the arrow directions through the entry on-off valve 15, to the saturator pressure control valve 5, through the three way valve 12, and enters the bottom (piping not shown) of the saturator 4. The gas then exits out of the top of the saturator, through the flow control valve 6, and exits to the downstream units (Gas Out).

Figure 6:
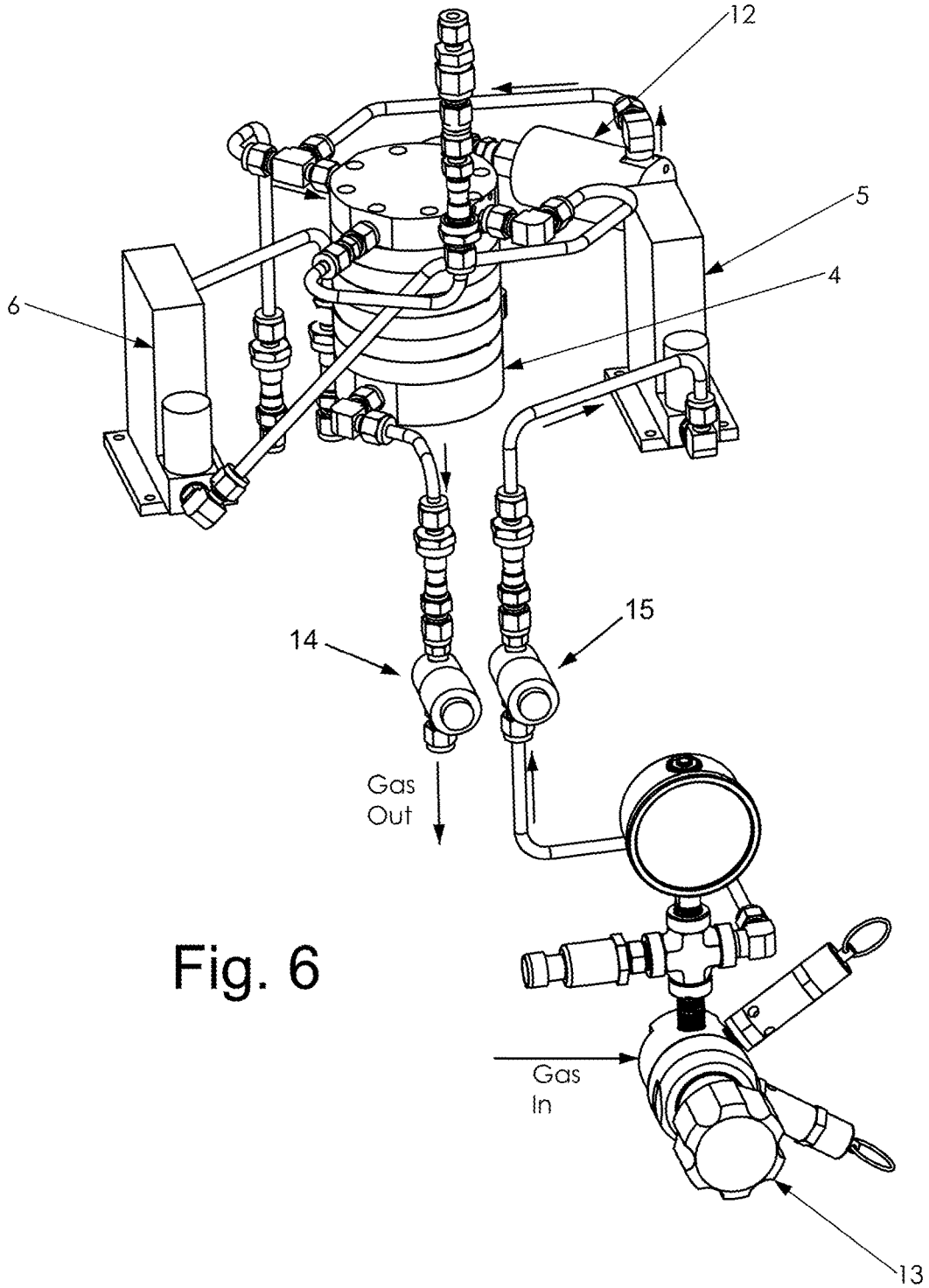
FIG. 6 shows a perspective view of the gas pressure—control sub assembly, with arrows indicating the direction of gas flow during a purge operation.

Similarly, FIG. 6 shows a purge cycle where the gas takes a similar entry route, except the three-way valve directs the gas into the top of the saturator 4 and then the gas exits (Gas Out) through the vent valve 14.

Saturator

The gas saturator assembly 4 comprises a series of vertically stacked round plates that are fused together by brazing. Each of the stacked plates incorporates an entry and exit hole for plate to plate gas flow. Each plate utilizes a machined pathway to maximize gas exposure to the liquid or frozen water residing in the pathway. The plate design directs the calibration gas around the pathway on each plate, causing the gas to admix with water vapor at the saturator pressure. Water within the pathway has a large exposed surface area to ensure high water vapor saturation efficiency into the gas stream. The water level of the pathway has adequate depth to ensure a sufficient humidity supply for a long period.

In one embodiment, the plates in the saturator are made from stainless steel. The plates are then fused together in a nickel brazing operation which completely seals the saturator so that it can withstand the saturator pressures needed during operation (up to 100 psi). In a preferred embodiment, the plates are made from copper for better thermal conductivity. For corrosion protection, the copper plates are electroplated with a corrosion resistant metal such as nickel, silver, rhodium, or gold. Nickel is a preferred electroplating metal as it readily self brazes together in a vacuum oven. In alternate embodiments, the saturator plates are aluminum or nickel and plated for corrosion protection.

When filling the saturator with distilled water, each stackable plate has a machined fill level point or dam which must be reached before the water spills over and down to the next plate. To fill the water channels in the saturator, a distilled water syringe (about 100 ml of water) is discharged into the top saturator plate. The initial fill is done top to bottom in the direction of gravity which is also in a direction counter to the normal gas flow through the saturator. A purge technique directs a gas flow in the same direction as the water during filling, pushing excess water from the top plate down toward the bottom plate and finally out an open vent (as mentioned in FIG. 6 description). This purge gas flow removes excess water from the saturator and may also be used to dry exit piping.

Alternately, a small pump may be used to fill the saturator for applications where there is more demand for water and/or a desire to fully automate the filling process.

The saturator temperature is controlled by two Stirling coolers, one at the top and one at the bottom, which provide a direct contact surface to cool the top and bottom of the saturator assembly. The cooling is readily transferred by conduction from contact between plates in the saturator assembly. Typically, the entire saturator is cooled to the desired temperature in less than an hour. The saturator is maintained at the required saturation temperature by two sensors situated in the upper and lower portion of the saturator. A PID control loop on each Stirling cooler monitors the saturator temperature and controls the coolers. Contact heaters are also installed to heat the saturator when required. A PID control loop monitors the two saturator temperature sensors previously mentioned and controls power applied to the heating elements. For more precise temperature control, a custom algorithm is employed whereby both the heating and cooling work simultaneously and in conjunction with one another.

The Stirling coolers cool the saturator by direct contact on the upper saturator surface and the lower saturator surface. The Sterling cooler is a piston style—gas expansion cooler.

Typically, due to the very low need for water to saturate the incoming gas, a 100 ml quantity of water could last for months. Typical humidity amounts in the exit gas are several parts per million to several parts per billion. However, the refill timing is highly dependent on the desired humidity and flow output.

The saturator is filled at atmospheric pressure and room temperature to assure a fill. It is readily understandable to those skilled in the art that a cold saturator (below 0° C.) will not fill properly due to the potential of freezing of the water while filling.

Optionally, the embodied humidity generator unit is provided with a battery backup when power reliability is suspect.

The embodied humidity generator will operate for days or months without any need for operator intervention.

The embodied humidity generator has a very small footprint verses other designs due to the compact design of the Stirling cooler units.

The embodied humidity generator is generally described as a single exit stream from the humidity generator to an external device for use. However, a plurality of exit streams could equally be generated by utilizing multiple exit flow control valves in a parallel flow orientation.

Operation of the Humidity Generator

The operator sets up the humidity generator, and the electronic controls takes care of any adjustment need to maintain the exit stream humidity level with little or no intervention by the operator. The embodied invention generates a humidity by:

A. Allowing the operator to select the desired output humidity in terms of dew point, frost point, parts per million, or another humidity related parameter.
B. Allowing the operator to select the desired flow rate.
C. The system will then measure the pressure of the output, or DUT, depending on the method of physical connection made by the user.
D. The system will measure the temperature at the DUT, if needed for the selected humidity output parameter.
E. Based on data from A C, and D, the system will select a suitable saturation temperature and begin control toward that temperature.
F. Based on parameter measurements and setpoints established in A, C, D, and E above, the system will compute the saturation pressure setpoint required to bring about the correct humidity output.
G. The system will continuously monitor all appropriate conditions, continuing to recompute setpoints for saturation temperature and saturation pressure as necessary.
H. The system will continually control saturation temperature, saturation pressure, and flow rate controls to achieve the required setpoint values, resulting in proper humidity output.

The humidity generator produces humidity values useful for calibrating and verifying instrumentation. The embodied humidity generator is fully capable of supply a continuous humidified gas stream, within the frost/dew point range of −90° C. to +10° C.

A humidity measuring instrument is not needed to determine the amount of humidity in the exit stream. Instead, the NIST fundamental principles of two-temperature and two-pressure humidity generation techniques are used and the known amount of humidity at those parameters is presumed to be the correct output.

Process Control

Figure 7:
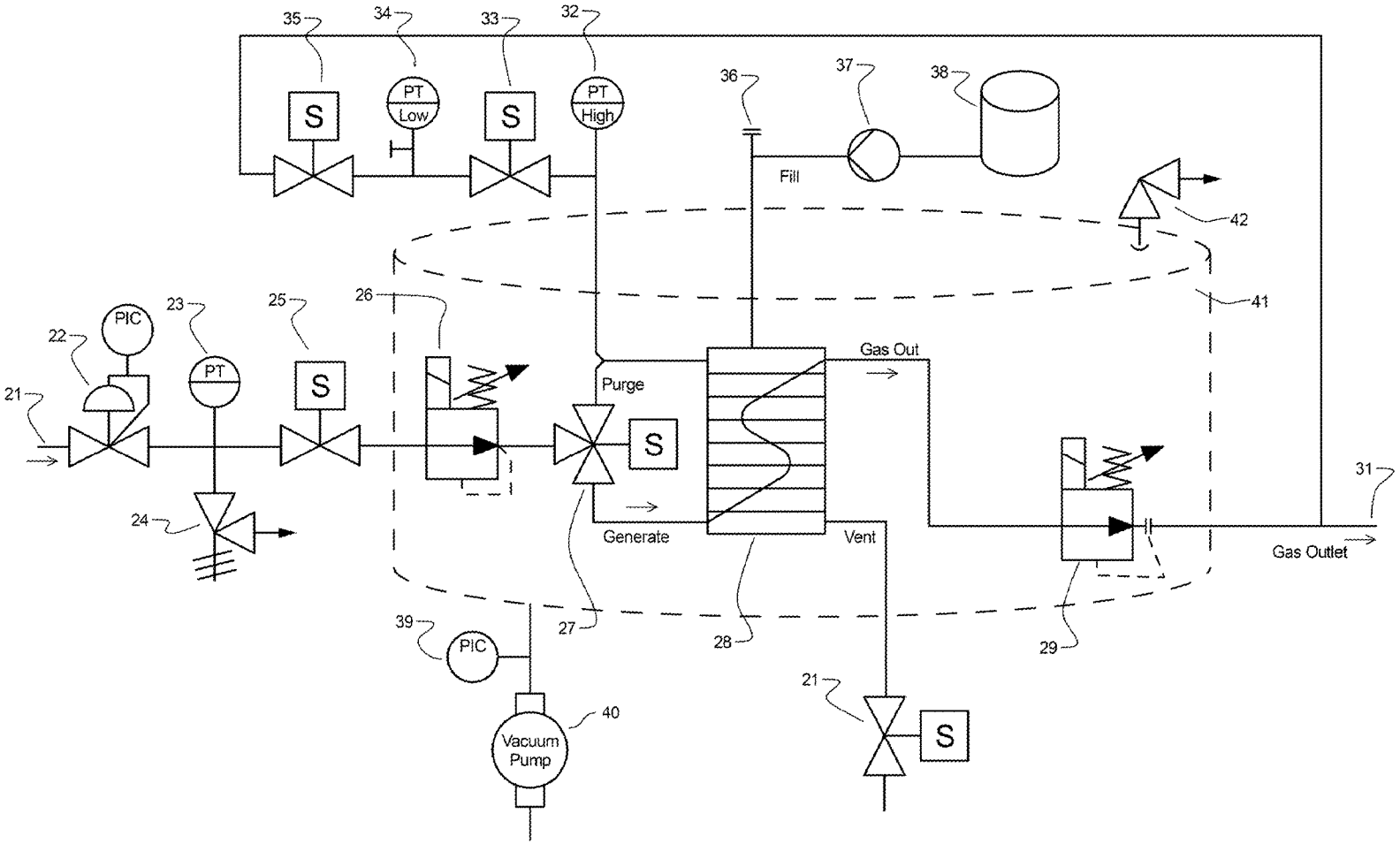
FIG. 7 shows a Process and Instrumentation Diagram schematic of the humidity generator.

Elements illustrated in FIG. 7:

| | |
|---|---|
| 21 | Inlet gas |
| 22 | Inlet pressure regulator |
| 23 | Inlet pressure transmitter |
| 24 | Inlet relief valve |
| 25 | Saturator on/off valve |
| 26 | Saturator pressure control valve |
| 27 | Three way valve |
| 28 | Saturator |
| 29 | Exit flow control valve |
| 31 | Exit Pressure |

-continued

| | |
|---|---|
| 32 | Saturator pressure transmitter (high range) |
| 33 | Blocking valve (1) |
| 34 | Exit pressure transmitter (low range) |
| 35 | blocking valve (2) |
| 36 | Water fill point |
| 37 | Water fill pump |
| 38 | Water fill tank |
| 39 | Vacuum pressure gauge |
| 40 | Vacuum pump |
| 41 | Vacuum chamber |
| 42 | Vacuum chamber over pressure valve |

Gas from a gas connection 21 flows to an inlet pressure regulator 22 to be reduced to approximately 150 psi. An on/off solenoid valve 25 allows the gas to go through a precise pressure regulator 26 to a three-way valve. The gas normally follows the generate path to the lower part of the saturator 28. It then goes out the top of the saturator to a flow control valve 29. Gas then exits the flow control valve and is directed to the DUT connected to the generator's outlet port 31. The saturator pressure is normally measured by a higher range saturator pressure transmitter 32. When saturation pressure is low, the saturation pressure is more accurately measured by the lower range exit pressure transmitter 34 by opening blocking solenoid valve 33 and closing blocking solenoid valve 35. In this case the exit pressure transmitter monitors both the exit pressure and saturator pressure in a 'switching' arrangement by toggling solenoid blocking valve 33 and solenoid blocking valve 35 on/off. The switching is for relatively short periods.

A three-way solenoid valve 27 directs the gas to either a purge cycle or a generate cycle. The purge cycle is used when filling the saturator 28 with water. The purge gas flows downwardly through the saturator and clears out excess water as previously described.

An over-pressure relief valve 23 is added to the vacuum chamber 41 to avoid damage to the vacuum chamber if the gas pressure regulator 26 fails open. If the vacuum camber 41 goes over pressure, then the relief valve 23 check valve will activate to relieve the pressure and prevent damage.

Electrical Control

Figure 8:
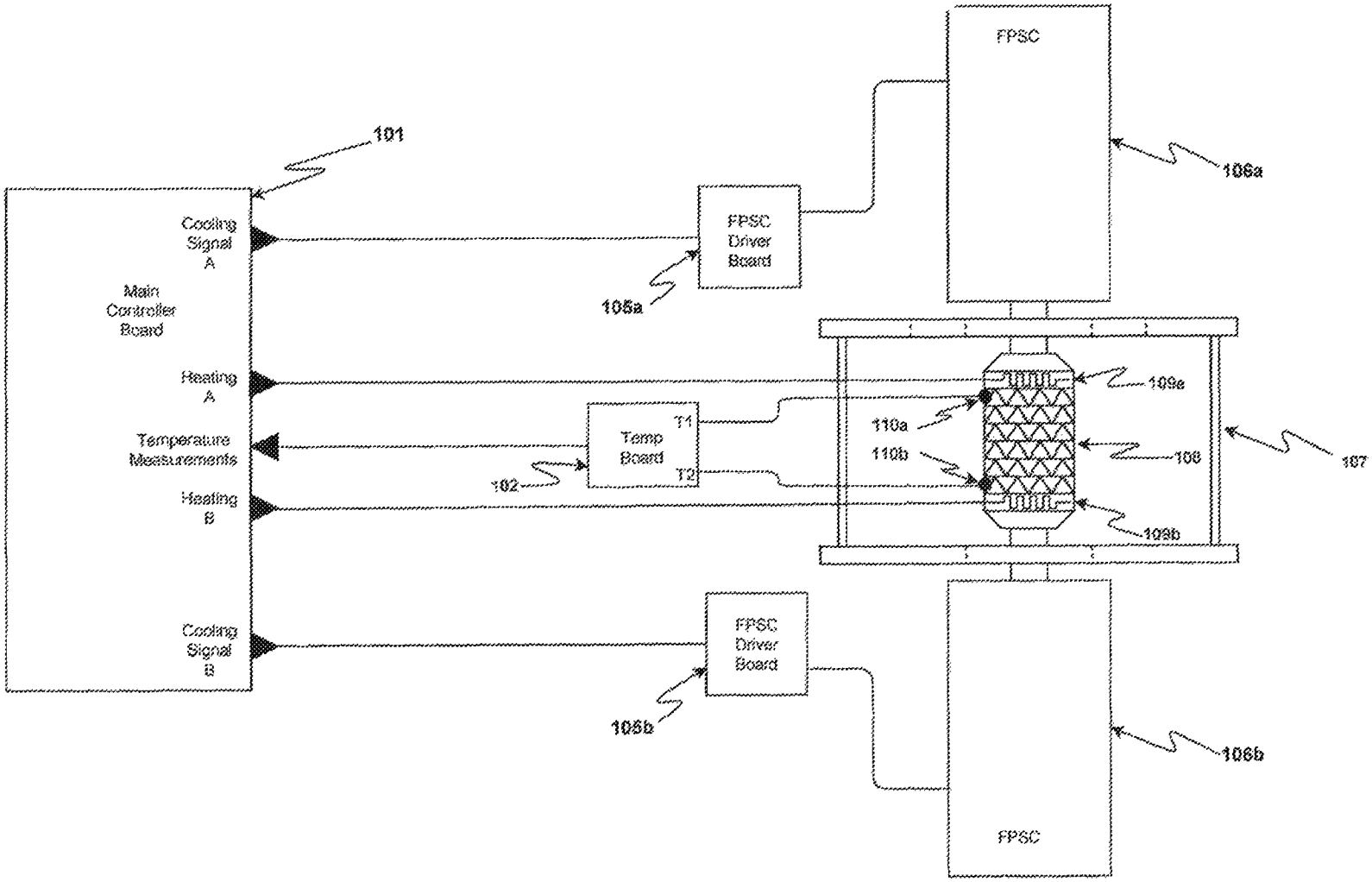
FIG. 8 shows an electrical schematic of the saturator temperature interface to the main controller board.
Figure 9:
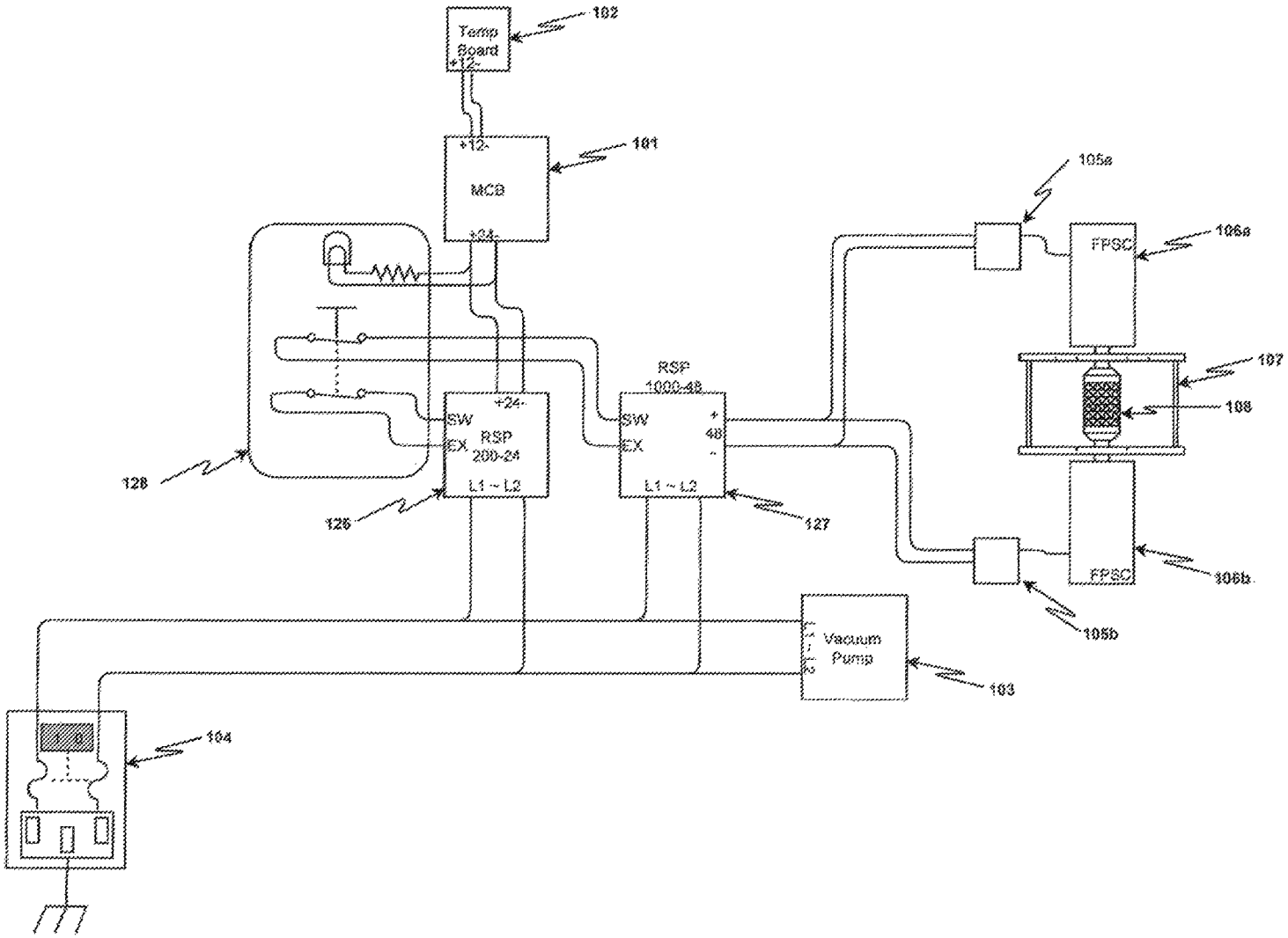
FIG. 9 shows an electrical power schematic of the vacuum pump and the Stirling coolers.
Figure 10:
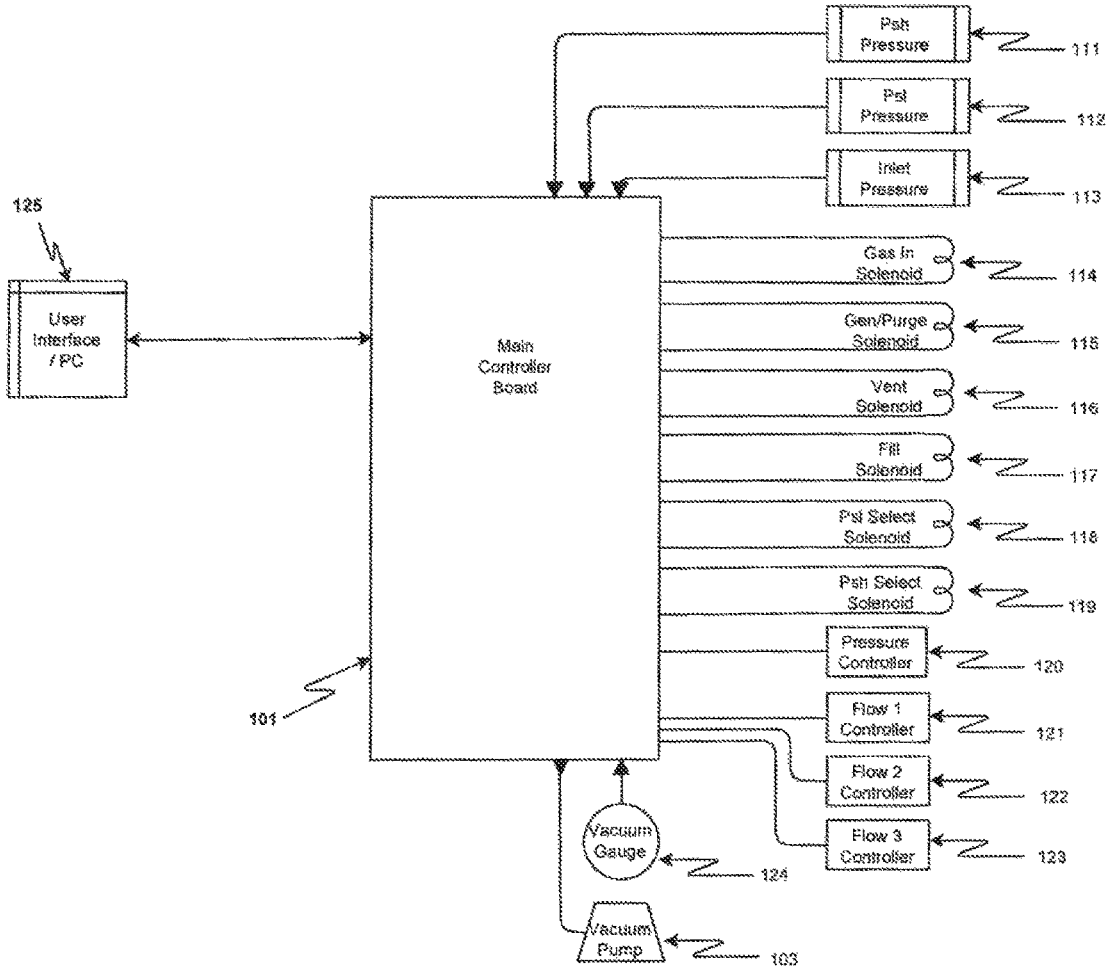
FIG. 10 shows the main controller board interface with sensors, valve solenoids, valve controllers, a vacuum pump, and a user interface.

In FIGS. 8-10, the following items are illustrated in the figures:

| | |
|---|---|
| 101 | Main controller board with analog and digital I/0, custom Firmware |
| 102 | Multi-channel high accuracy temperature measuring circuit |
| 103 | Vacuum Pump |
| 104 | AC input power receptacle |
| 105a | Electronic control circuit to drive 106a |
| 105b | Electronic control circuit to drive 106b |
| 106a | Free Piston Stirling Cooler (FPSC) |
| 106b | Free Piston Stirling Cooler (FPSC) |
| 107 | Vacuum chamber |
| 108 | Saturator |
| 109a | Heater Top |
| 109b | Heater Bottom |
| 110a | Saturator Temperature Sensor a (upper) |
| 110b | Saturator Temperature Sensor b (lower) |
| 111 | Saturator pressure sensor (transmitter) |
| 112 | Exit pressure sensor (transmitter) |
| 113 | gas inlet pressure sensor |
| 114 | Gas inlet valve |
| 115 | Directional valve to select gas flow path purge/generate |
| 116 | Vent valve solenoid |
| 117 | Water fill valve solenoid |

-continued

| | |
|---|---|
| 118 | Pressure selection valve low (Psl) |
| 119 | Pressure selection valve high (Psh) |
| 120 | Pressure controller |
| 121 | Flow 1 controller |
| 122 | Flow 2 controller - optional |
| 123 | Flow 3 controller - optional |
| 124 | Vacuum gauge sensor |
| 125 | User Interface with PC - custom programming |
| 126 | 24 VDC power supply |
| 127 | 48 VDC power supply |
| 128 | Power switch with integrated LED indicator |

A multifunction custom printed circuit board is used to control and operate the low humidity generator.

In FIG. 8, temperature control of the saturator is attained by two PID control loops which use saturator temperature measurements 110*a,b* connected to a temperature measuring board 102 that is connected to the main controller board 101. The main controller board then directs the Stirling control driver boards 105*a,b* to control the Stirling coolers 106*a,b* to the desired temperature. The two temperature measurements are located on the upper and lower sections of the saturator. The control temperature is typically any value between −90° C. and 10° C.

FIG. 9 shows the power setup to the main controller board 101 and the temperature board 102 which are based on a 24 VDC power supply 126. The Stirling coolers are powered by a 48 VDC power supply 127. A power switch 128 energizes the power supplies 126,127 and has an integral LED light.

FIG. 10 shows the main controller board 101 connections to various sensors 111-113, solenoids 114-119, and controllers 120-123. Also, a user interface/personal computer connection 128 is shown. The computer connection (or mobile computer device) follows a communication protocol that is common and known in the art. The vacuum gauge sensor 124 and vacuum pump control 103 also connects to the main controller board 101. All of the sensor connections and controller connections are analog, serial, parallel, or wireless, and utilize communication protocols that are common and known in the art.

The main controller board 101 is customized and provides both PID loop process control and logic control for the humidity generator. (FIG. 10)

A humidity generator can provide more than one exit flow. Provisions for up to three independent exit flow controllers 121-123 are illustrated. More than three can be provided.

Gas Flow and Pressure Control (FIG. 7)

Gas pressure in the saturator is controlled by a pressure control valve 26 equipped with integral pressure measurement used for feedback. The saturator 28 has comparatively little pressure loss for normal gas flow rates, and the water vapor is admixed with the carrier gas at the temperature and pressure of the saturator. A PID pressure control algorithm provides for even and steady state pressure control.

Similarly, the exit flow rate control is provided after the saturator by a flow control valve 29 with an integral flow meter for measurement and feedback. A PID control algorithm provides for even and steady state exit gas flow.

The exit gas pressure after the saturator exit flow valve 29 will vary depending upon the downstream device utilizing the gas, often called the device under test (DUT). If the DUT instrument vents to atmosphere, the generator exit pressure will be near atmospheric. If the DUT instruments use a back pressure venting valve, or utilize other flow restriction mechanisms, the generator exit pressure will be elevated based on the back pressure setpoint or the flow rate used. In either case, the exit pressure is typically very steady. The flow controller 29 will continue to maintain the desired flow rate, and the saturator pressure controller 26 will automatically adjust to maintain the desired humidity output setpoint.

Operational Control (FIG. 7)

In normal operation, the carrier gas (usually compressed air or nitrogen) is directed through (in order):

1. an initial mechanical pressure valve 22 to reduce the pressure to an acceptable amount.
2. a saturator on-off solenoid operated valve 25.
3. a saturator pressure control valve with integral exit pressure feedback 26. The exit pressure is the pressure of a humidity saturator (or simply 'saturator').
4. the saturator 28 comprised of a number stacked plates with channels containing pure liquid water or ice laying in machined channels on the stacked plates.
5. an exit flow valve 29.

For maintenance, the vacuum chamber is relatively easy to access. The humidity generator unit is turned off, air is allowed to enter the vacuum chamber, and then the vacuum chamber is disassembled. All of the gas components and electrical wiring inside the vacuum chamber are then available for service.

Pressure Sensor Accuracy (FIG. 7)

The accuracy of the pressure sensors in the saturator and the exit gas pressure is very important to the accuracy of the humidity level. Typical pressure sensor accuracy is 0.05% full scale. The saturator can operate to a pressure of up to 100 psi, and to as low as near ambient pressure. To improve the humidity control and measurement, both the higher range saturator pressure sensor and the exit (lower range pressure sensor) are able to to monitor the saturator pressure. Due to the mathematical relationship of saturator and exit pressures in the generation of humidity, the need for increased measurement accuracy becomes important at the lower saturator pressures. To ensure accuracy while the saturator is at low pressures (near ambient), the exit range pressure transmitter 34 assumes a time-sharing measurement role. The exit pressure transmitter 34 measures the saturator 28 for a short period by closing blocking valve 35 and opening blocking valve 33. It then measures the exit or DUT pressure 31 for a short period by closing blocking valve 33 and opening blocking valve 35. This time-sharing of the exit pressure transmitter continues while the saturator pressure remains within the range of the exit pressure transmitter 34.

Because the lower range exit transmitter 34 is damaged when exposed to the higher operating range of the saturator, a solenoid valve 33 blocks the lower range sensor to protect it when the saturator pressure is higher than the sensor's measuring capability. During this time, the exit pressure transmitter 34 monitors only the exit or DUT pressure 31 by closing blocking valve 33 and opening blocking valve 35. So, while the saturator pressure is above the allowable range of the low pressure sensor, the exit pressure transmitter 34 monitors the exit or DUT pressure fully and does not time-share.

It is desirable to be able to check calibration of the pressure transmitters 32, 34 while running. For this purpose, a pneumatic fitting is installed at the pneumatic junction of the saturator pressure transmitter 32 and the blocking valve 33. A reference pressure may be connected to this fitting and used as a comparison measurement to the saturator pressure transmitter. In this case, blocking valve 33 will be closed.

For comparison to the low range exit pressure sensor 34, blocking valve 35 will be closed and blocking valve 33 will be open.

Benefits

The vacuum chamber improves accuracy of generated humidity by significantly reducing the problem of higher than expected humidity output due to the problem of permeation of external water vapor into the gas stream through O-rings and other connections. Since the external portion of O-rings and connections are physically located within the vacuum environment, they are contained in a low water vapor pressure environment. And since the inside of the O-rings and joints are at a low water vapor pressure because of the generated humidity, the normally large differential water vapor pressure between inside and outside of connections is significantly reduced, thus reducing the driving force behind the permeation, and the negative effects it would otherwise impose.

The vacuum chamber also provides thermal isolation. It is known that thermal losses are mostly through contact with the ambient air and conductivity on support components. The vacuum chamber eliminates these kinds of heat losses. Also, the saturator is suspended in the chamber by direct contact with the Stirling coolers, so there is no thermal warming from saturator mounting equipment. Radiant heating through the vacuum chamber is very minimal.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. A humidity generator for a low dewpoint gas comprising:

A. a vacuum chamber, wherein:
  i. a saturator,
  ii. a saturator pressure control valve connected to said saturator, and
  iii. an exit flow control valve connected to said saturator,
  are located within said vacuum chamber,
B. a vacuum pump connected to said vacuum chamber,
C. an upper Stirling cooler thermally connected to an upper surface of said saturator, and
D. a lower Stirling cooler thermally connected to a lower surface of said saturator.

2. The humidity generator according to claim 1, additionally comprising:

A. an upper temperature PID control loop connected to:
  i. an upper temperature sensor located in said saturator, and
  ii. said upper Stirling cooler,
B. a lower temperature PID control loop connected to:
  i. a lower temperature sensor located in said saturator, and
  ii. said lower Stirling cooler,
C. a pressure PID control loop connected to said saturator pressure control valve,
D. a flow PID control loop connected to said exit flow control valve.

3. The humidity generator according to claim 2, wherein said saturator is connected to:

A. a saturator pressure transmitter accurate to within +/−0.05% full scale, and
B. an exit pressure transmitter accurate to within +/−0.05% full scale.

4. The humidity generator according to claim 3, wherein a blocking valve is connected between said exit pressure transmitter and said saturator.

5. The humidity generator according to claim 4, additionally comprising:

A. a gas inlet connected to a shutoff valve, and
B. said shutoff valve is connected to said saturator pressure control valve.

6. The humidity generator according to claim 5, additionally comprising:

A. a nitrogen gas supply connected to said inlet gas connection, or
B. a compressed gas supply connected to said inlet gas connection.

7. The humidity generator according to claim 6, additionally comprising a three-way solenoid valve connected to:

A. a top connection to said saturator,
B. a bottom connection to said saturator, and
C. said saturator pressure control valve.

8. The humidity generator according to claim 7, additionally comprising a second exit flow control valve connected to said saturator.

9. The humidity generator according to claim 8, wherein said saturator comprises an assembly of multiple stacked plates.

10. The humidity generator according to claim 1, wherein

A. a first heating element that is thermally connected to:
  i. said upper Stirling cooler,
  ii. said upper surface of said saturator, or
  iii. said upper Stirling cooler and said upper surface of said saturator,
B. a second heating element is thermally connected to:
  i. said lower Stirling cooler,
  ii. said lower surface of said saturator, or
  iii. said lower Stirling cooler and said lower surface of said saturator.

11. A method of generating a low dewpoint gas in a humidity generator comprising:

A. providing:
  a. a vacuum chamber, wherein:
    i. a saturator,
    ii. a saturator pressure control valve connected to said saturator, and
    iii. an exit flow control valve connected to said saturator, are located within said vacuum chamber,
  b. a vacuum pump connected to said vacuum chamber,
  c. an upper Stirling cooler in contact with an upper surface of said saturator, and
  d. a lower Stirling cooler in contact with a lower surface of said saturator
  e. an upper temperature PID control loop connected to:
    i. an upper temperature sensor located in said saturator, and
    ii. said upper Stirling cooler,
  f. a lower temperature PID control loop connected to:
    i. a lower temperature sensor located in said saturator, and
    ii. said lower Stirling cooler,
  g. a pressure PID control loop connected to said saturator pressure control valve,
  h. a flow PID control loop connected to said exit flow control valve,
  and
B. prefilling said saturator with distilled water at atmospheric pressure, C. operating said vacuum pump to create a predetermined vacuum in said vacuum chamber, D. connecting a supply gas to a gas inlet connected to said humidity generator, and E. operating:

a. said upper temperature PID control loop, b. said lower temperature PID control loop, c. said pressure PID control loop, and d. said flow PID control loop, according to predetermined setpoints, and F. whereby an exit gas is generated with a dewpoint between −90° C. and 10° C.

12. The method of generating a low dewpoint gas according to claim 11, wherein said saturator is connected to:

A. a saturator pressure transmitter accurate to within +/−0.05% full scale, and

B. an exit pressure transmitter accurate to within +/−0.05% full scale.

13. The method of generating a low dewpoint gas according to claim 12, wherein a blocking valve is connected between said exit pressure transmitter and said saturator.

14. The method of generating a low dewpoint gas according to claim 13, additionally comprising:

A. a gas inlet connected to a shutoff valve, and

B. said shutoff valve is connected to said saturator pressure control valve.

15. The method of generating a low dewpoint gas according to claim 14, additionally comprising:

A. a nitrogen gas supply connected to said inlet gas connection, or

B. a compressed gas supply connected to said inlet gas connection.

16. The method of generating a low dewpoint gas according to claim 15, additionally comprising a three-way solenoid valve connected to:

A. a top connection to said saturator,

B. a bottom connection to said saturator, and

C. said saturator pressure control valve.

17. The method of generating a low dewpoint gas according to claim 16, additionally comprising a second exit flow control valve connected to said saturator.

18. The method of generating a low dewpoint gas according to claim 17, wherein said saturator comprises an assembly of multiple stacked plates.

19. The method of generating a low dewpoint gas according to claim 11, wherein A. a first heating element thermally connected to:

i. said upper Stirling cooler, ii. said upper surface of said saturator, or iii. said upper Stirling cooler and said upper surface of said saturator, B. a second heating element thermally connected to:

i. said lower Stirling cooler, ii. said lower surface of said saturator, iii. said lower Stirling cooler and said lower surface of said saturator.

* * * * *